US006617783B2

(12) United States Patent
Nakamura

(10) Patent No.: US 6,617,783 B2
(45) Date of Patent: Sep. 9, 2003

(54) ELECTROLUMINESCENCE FIBER

(76) Inventor: Hideichi Nakamura, 1-4-1215, Kawara-machi, Saiwai-ku, Kawasaki-shi, Kanagawa 210-0907 (JP)

( * ) Notice: Subject to any disclaimer, the term of this patent is extended or adjusted under 35 U.S.C. 154(b) by 0 days.

(21) Appl. No.: 10/079,402

(22) Filed: Feb. 22, 2002

(65) Prior Publication Data

US 2002/0130624 A1 Sep. 19, 2002

(30) Foreign Application Priority Data

Mar. 16, 2001 (JP) ..... 2001-076103

(51) Int. Cl.[7] ..... H05B 33/00

(52) U.S. Cl. ..... 313/505; 313/506; 313/511; 315/169.3

(58) Field of Search ..... 313/509–512, 313/502, 506; 315/169.3, 161; 428/690, 917, 505–512

(56) References Cited

U.S. PATENT DOCUMENTS 4,104,555 A * 8/1978 Fleming ..... 313/512
5,876,863 A * 3/1999 Feldman et al. ..... 313/505
5,959,402 A * 9/1999 Polyan ..... 313/511
6,355,125 B1 * 3/2002 Tahon et al. ..... 156/99

* cited by examiner

*Primary Examiner*—Don Wong
*Assistant Examiner*—Wilson Lee
(74) *Attorney, Agent, or Firm*—Armstrong, Westerman & Hattori, LLP

(57) ABSTRACT

A flexible electroluminescence fiber has an electroluminescence device and electrodes disposed on both sides of the electroluminescence device. The surface of the electroluminescence device, including the electrodes, is covered with a thermoplastic resin, a thermosetting resin or an ultraviolet-curing resin, which is then cured. The resin surface is integrally formed with a function-assisting portion for assisting the function of the electroluminescence fiber to retain the sectional configuration of the electroluminescence fiber and to attain ease of installation on a wall surface or the like and replacement, and ease of electrical connection, and ease of increasing the amount and apparent width of light emitted from the electroluminescence fiber.

5 Claims, 15 Drawing Sheets

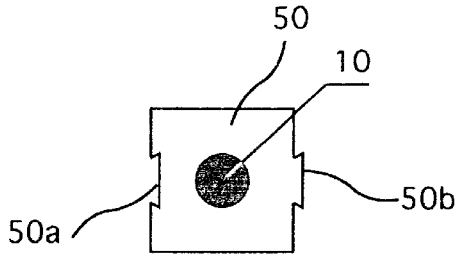
FIG. 6(a)
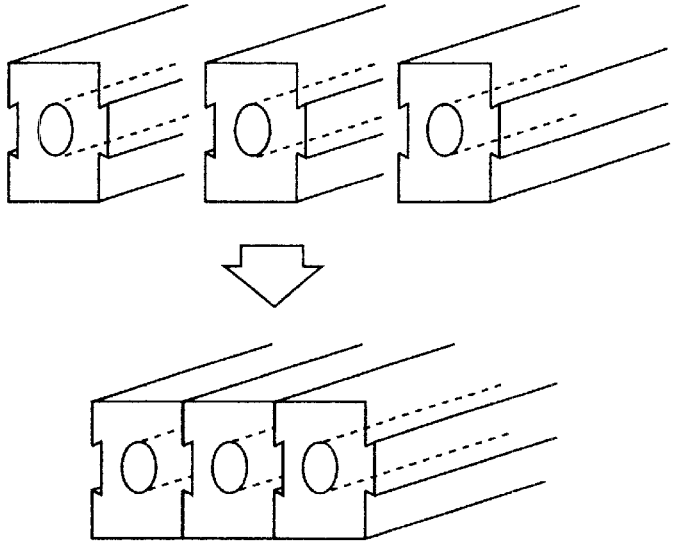
FIG. 6(b)
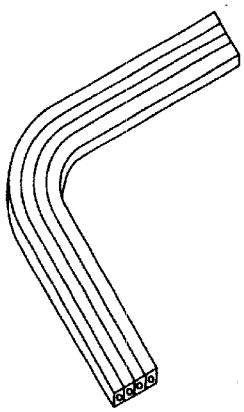
FIG. 6(c-1)
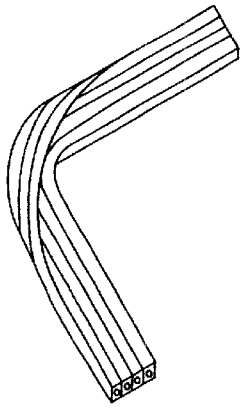
FIG. 6(c-2)

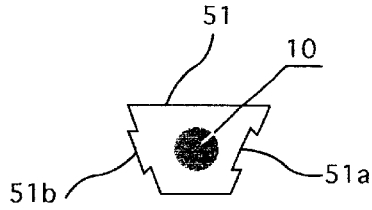
FIG. 7(a)
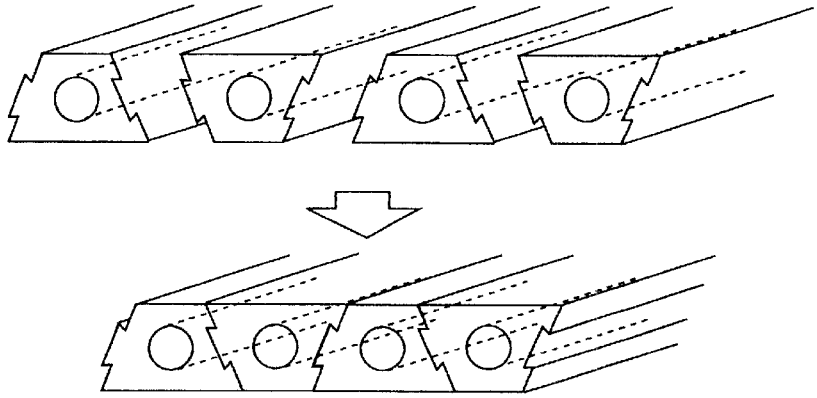
FIG. 7(b)
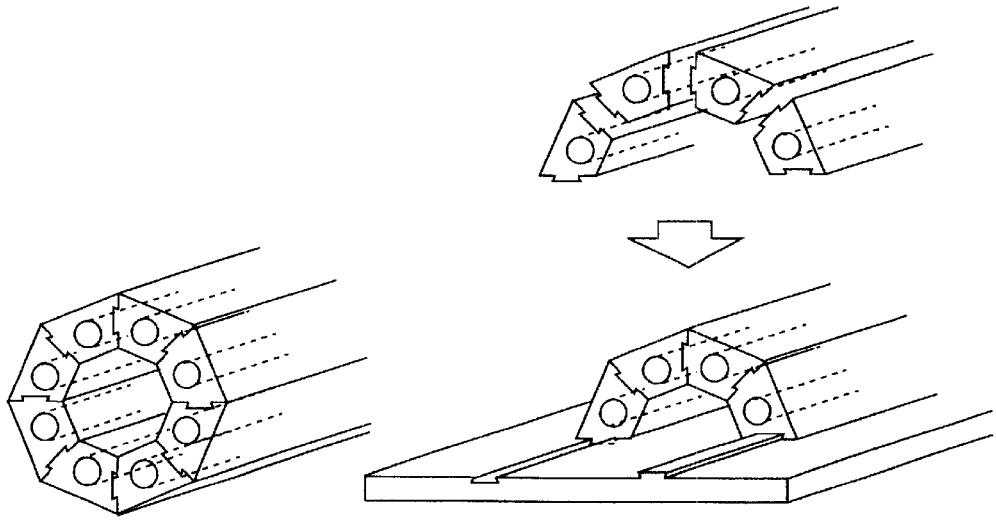
FIG. 7(d)
FIG. 7(c)

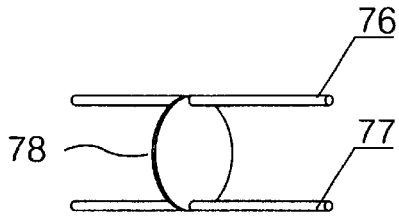
FIG. 11(a)
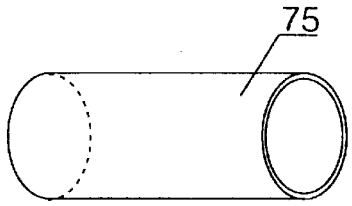
FIG. 11(b)
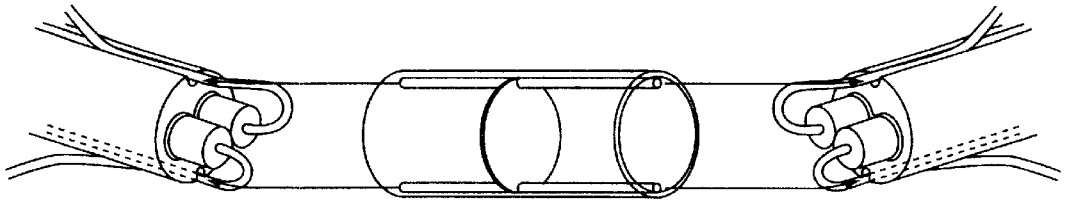
FIG. 11(c-1)
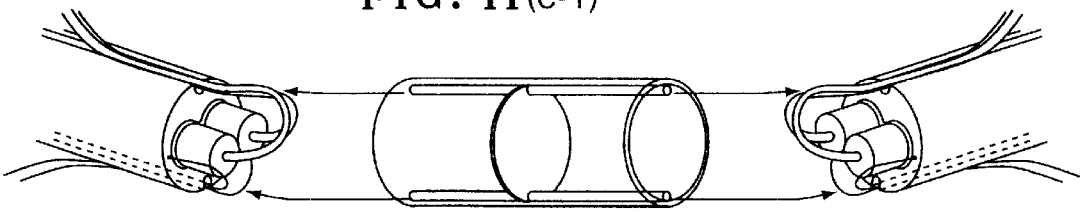
FIG. 11(c-2)

ELECTROLUMINESCENCE FIBER

BACKGROUND OF THE INVENTION

1. Field of the Invention

The present invention relates to an electroluminescence fiber (abbreviated to "ELF") improved by devising various schemes for the surface configuration thereof.

2. Discussion of Related Art

FIGS. 1(*a*) and 1(*b*) are diagrams illustrating the general arrangement of electroluminescence fibers. Part (a) of FIG. 1 shows an electroluminescence fiber having a single core electrode. Part (b) of FIG. 1 shows an electroluminescence fiber having two core electrodes.

In part (a) of FIG. 1, an electroluminescence layer 1 is disposed to surround a core electrode 3-1 provided at the center of the electroluminescence fiber. Two additional electrodes 3-2 are disposed on the surface of the electroluminescence layer 1. The whole structure is covered with a flexible colored resin layer 2. A voltage is applied between the core electrode 3-1 and the additional electrodes 3-2 to generate an electric field, whereby the electroluminescence layer 1 is caused to emit light with the color of the colored resin layer 2. It should be noted that the electroluminescence layer may be formed from a powder material or a solidified powder material. Examples of additional electrodes include those formed in a straight-line shape or wound around the electroluminescence device.

In part (b) of FIG. 1, two electroluminescence layers 1 are provided to surround respective core electrode 3-1 each disposed a predetermined distance away from the center of the electroluminescence fiber. Two additional electrodes 3-2 are disposed on the respective surfaces of the electroluminescence layers 1. The whole structure is covered with a flexible colored resin layer 2. In this electroluminescence fiber, the amount of electroluminescent material per unit length is increased to enhance the luminance in comparison to the electroluminescence fiber shown in part (a) of FIG. 1.

Because it is flexible, the electroluminescence fiber can be formed into various shapes such as letters and numerals and is therefore suitable for use as an advertising sign or a decoration. However, the shape of the electroluminescence fiber cannot be retained by itself. Therefore, to use the electroluminescence fiber as an advertising sign or a decoration, it is important to allow its shape to be retained by some means and to attain ease of installing the electroluminescence fiber on a wall surface or the like, ease of attaching and detaching the electroluminescence fiber to and from a support sewn on cloth or the like, ease of electrical connection, and ease of increasing the amount and apparent width of light emitted from the electroluminescence fiber.

SUMMARY OF THE INVENTION

An object of the present invention is to provide an electroluminescence fiber designed so that the sectional configuration of the electroluminescence fiber can be retained and it is possible to attain ease of installation on a wall surface or the like and replacement, ease of electrical connection, and ease of increasing the amount and apparent width of light emitted from the electroluminescence fiber.

Accordingly, the present invention provides a flexible electroluminescence fiber having an electroluminescence device and electrodes disposed on both sides of the electroluminescence device. The surface of the electroluminescence device, including the electrodes, is covered with a thermoplastic resin, a thermosetting resin, or an ultraviolet-curing resin, which is then cured. The resin surface is integrally formed with a function-assisting portion for assisting the function of the electroluminescence fiber.

The function-assisting portion may be at least one flat surface portion, an unevenness pattern for diffusion of light, a prism- or lens-shaped portion, a fitting portion for joining with an adjacent electroluminescence fiber or an electroluminescence fiber support, or a groove for securing a wiring end portion of each electrode, which are formed on the resin surface.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIGS. 7(*a*)–7(*d*) are diagrams showing another example in which an extrusion die is devised to allow a plurality of electroluminescence fibers to be joined together.

FIGS. 11(*a*), 11(*b*), 11(*c*-1) and 11(*c*-2) are diagrams illustrating another example of the connecting terminal.

DESCRIPTION OF THE PREFERRED EMBODIMENTS

Embodiments of the present invention will be described below.

Figures 2A, 2B:
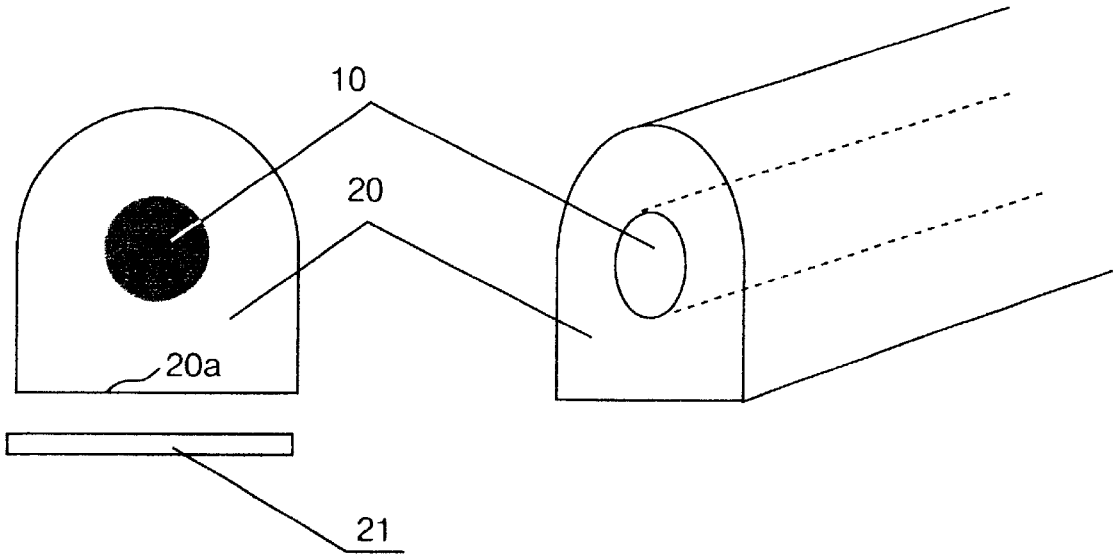
FIGS. 2(*a*) and 2(*b*) are diagrams illustrating an embodiment of the electroluminescence fiber according to the present invention.

FIGS. 2(*a*) and 2(*b*) are diagrams illustrating an embodiment of the electroluminescence fiber according to the present invention. Part (a) of FIG. 2 is a sectional view, and part (b) of FIG. 2 is a perspective view.

The electroluminescence fiber has an electroluminescence device 10 formed in a linear configuration by wrapping an electroluminescent powder with a polyethylene film, for example. The electroluminescence device 10 has, for example, two core electrodes disposed in the electroluminescent powder. If necessary, the electroluminescence device 10 is covered with an appropriate colorless transparent or colored tube. The electroluminescence device 10 is flexible and hence capable of being bent into a desired shape.

The surface of the electroluminescence device 10 is covered with a covering layer 20 of a thermoplastic resin, e.g. a polyurethane resin, a polyester resin, an epoxy resin, or a phenolic resin, by extrusion process. In this embodiment, the die used in the extrusion process has a semicylindrical shape (with a flat surface at the bottom). With this die, extrusion is carried out to cover the surface of the electroluminescence device 10 with a thermoplastic resin. Consequently, as shown in part (a) of FIG. 2, a semicylindrical covering layer 20 is formed on the surface of the electroluminescence device 10. The covering layer 20 is made of a thermoplastic resin having the property that it becomes plastic at a temperature above a hundred and several tens of degrees centigrade, for example, and cures at at least ordinary room temperatures. When the extruded covering layer 20 is cured by lowering the temperature to an ordinary temperature, an electroluminescence fiber is completed with a shape fixed to a semicylindrical configuration having one flat surface 20*a*, as illustrated in the figure.

If an adhesive material 21 such as double-coated adhesive tape is stuck to the flat surface 20*a*, the electroluminescence fiber can be readily installed on a wall surface or the like. The electroluminescence layer of the electroluminescence fiber is readily breakable by bending, twisting, etc. Therefore, it is very likely that the electroluminescence layer will break if the electroluminescence fiber is twisted during installation. However, the use of the flat surface 20*a* makes it possible to prevent the enclosed electroluminescence device 10 from twisting during installation. The conventional electroluminescence fiber has a circular or elliptical sectional configuration. Therefore, installation of the electroluminescence fiber on a wall surface or the like is carried out as follows. A support is secured to the wall surface by using double-coated adhesive tape or securing members such as fastening screws or nails, and the electroluminescence fiber is fitted into the support secured to the wall surface, thereby fixing the shape and orientation of a figure or a letter formed by the electroluminescence fiber. The electroluminescence fiber according to this embodiment has a flat surface portion 20*a* and is therefore capable of being readily secured to a wall surface or the like by making use of the flat surface portion 20*a*. Accordingly, the flat surface portion 20*a* serves as a function-assisting portion for assisting the function of the electroluminescence fiber.

Figures 3A, 3B:
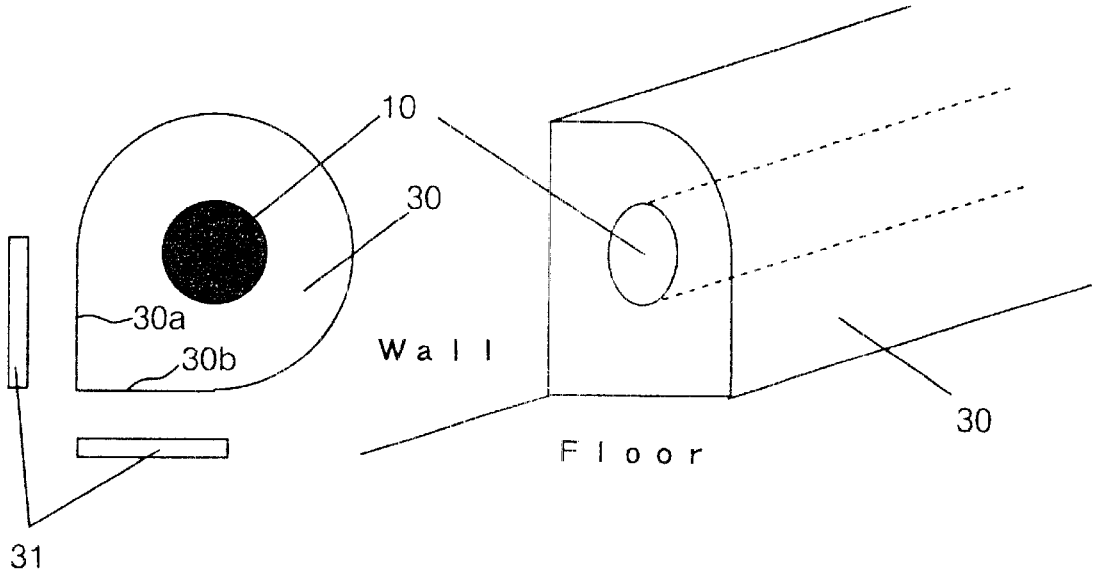
FIGS. 3(*a*)–3(*d*) are diagrams showing another embodiment of the present invention.
Figures 3C, 3D:
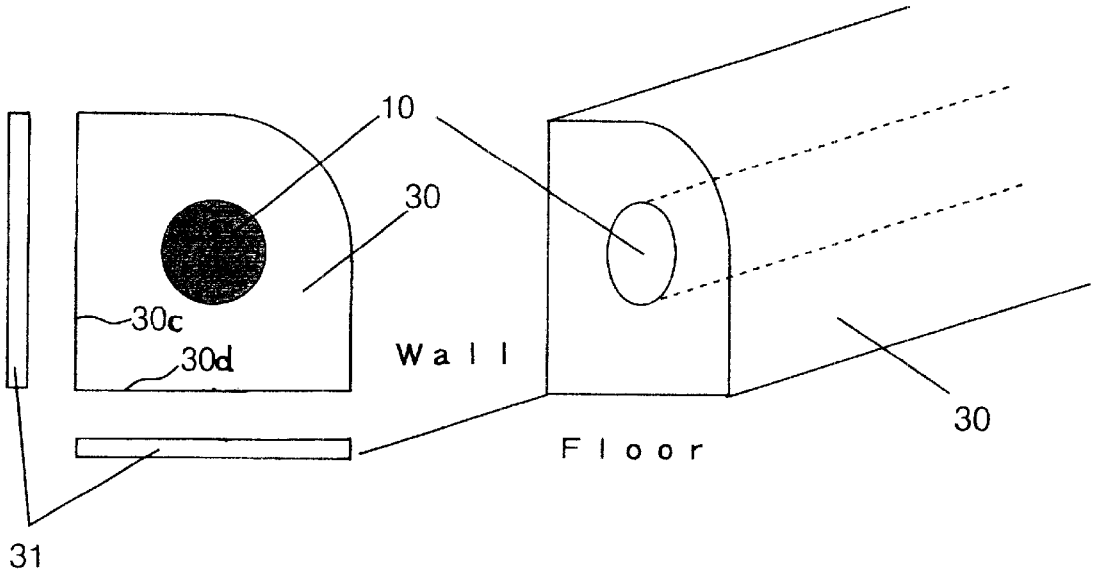

FIGS. 3(*a*)–3(*d*) are diagrams showing another embodiment of the present invention, in which: part (a) is a sectional view; part (b) is a perspective view; part (c) is a sectional view; and part (d) is a perspective view.

In this embodiment, an extrusion die having two flat surface portions (30*a* and 30*b*) or (30*c* and 30*d*) is used. With this die, extrusion is carried out to cover the surface of a linear electroluminescence device 10 with a covering layer 30 of a thermoplastic resin, and the covering layer 30 is cured. As shown in parts (a) and (c) of FIG. 3, the covering layer 30 is formed with a pair of adjacent flat surface portions (30*a* and 30*b*) or (30*c* and 30*d*) intersecting each other at right angles, and this shape is fixed. By sticking adhesive materials 31 such as double-coated adhesive tape to the flat surface portions, the electroluminescence fiber can be readily secured to a corner between a wall surface and a floor, for example, as shown in parts (b) and (d) of FIG. 3. Accordingly, the surface portions (30*a* and 30*b*) or (30*c* and 30*d*) serve as function-assisting portions for assisting the function of the electroluminescence fiber.

Figures 4A, 4B:
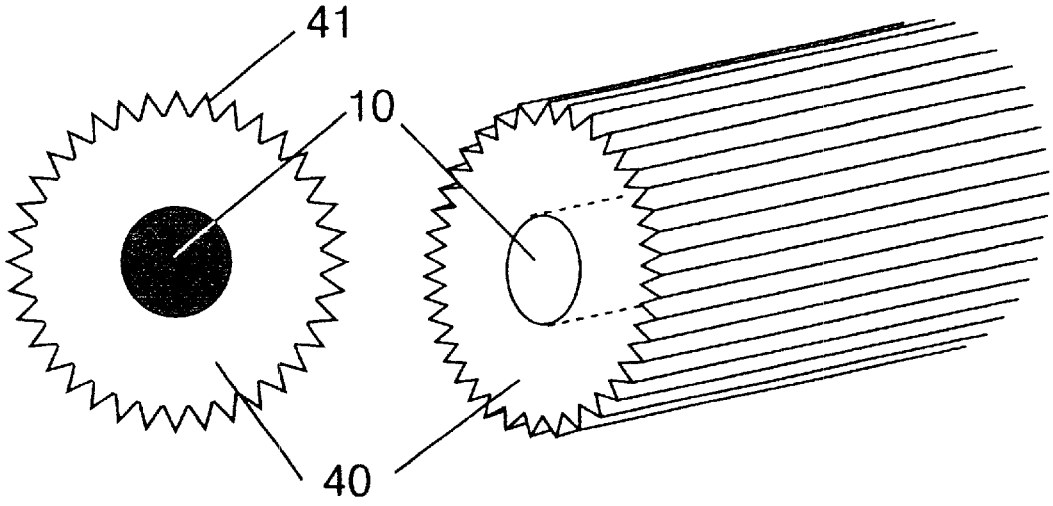
FIGS. 4(*a*) and 4(*b*) are diagrams showing another embodiment of the present invention

FIGS. 4(*a*) and 4(*b*) are diagrams showing another embodiment of the present invention Part (a) of FIG. 4 is a sectional view, and part (b) of FIG. 4 is a perspective view.

In this embodiment, extrusion is carried out by using an extrusion die formed with an unevenness pattern to cover the surface of a linear electroluminescence device 10 with a covering layer 40 of a thermoplastic resin, and the covering layer 40 is cured. As illustrated in the figure, the surface of the covering layer 40 is formed with a serrate pattern 41 consisting of a large number of longitudinally extending parallel grooves, and this shape is fixed. Thus, light emitted from the electroluminescence device 10 is diffused to allow the thickness of the electroluminescence device 10 to appear large. Conventionally, the outer side of the electroluminescence device 10 is wound with a transparent resin fiber or the like or covered with a semitransparent resin for the purpose of diffusing light. Alternatively, the electroluminescence device 10 is helically accommodated in a tube for light-diffusing purposes. According to this embodiment, such an incidental operation can be dispensed with. Further, a light-diffusion effect can be readily obtained without degrading the luminance of the electroluminescence device 10 as in a case where it is covered with a semitransparent resin, and without causing the line of light from the electroluminescence device 10 to appear zigzag as in a case where the electroluminescence device 10 is helically accommodated in a tube. Thus, it is possible to allow the thickness of the electroluminescence device 10 to appear large. In this embodiment, the serrate pattern 41 serves as a function-assisting portion for assisting the function of the electroluminescence fiber.

Figure 5:
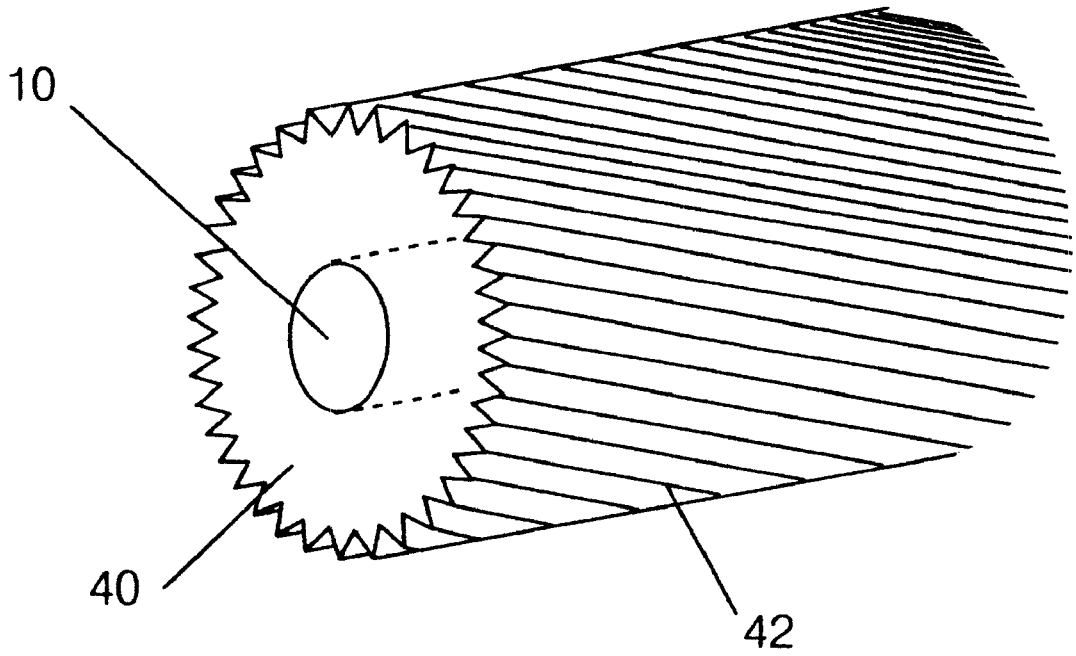
FIG. 5 is a diagram showing another embodiment of the present invention FIGS. 6(*a*), 6(*b*), 6(*c*-1) and 6(*c*-2) are diagrams showing an example in which an extrusion die is devised to allow a plurality of electroluminescence fibers to be joined together.
Figure 8A:
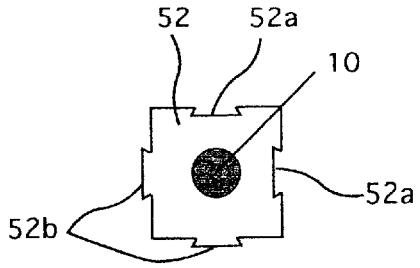
FIGS. 8(*a*)–8(*d*) are diagrams showing another example in which an extrusion die is devised to allow a plurality of electroluminescence fibers to be joined together.
Figure 8C:
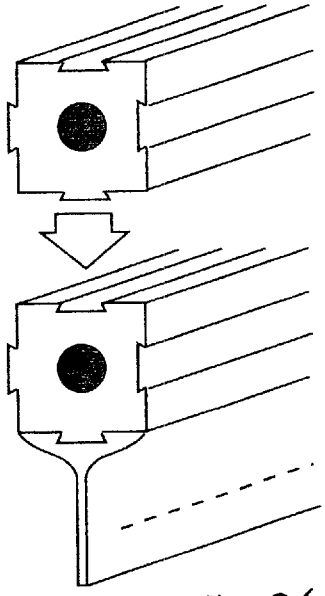
Figure 8B:
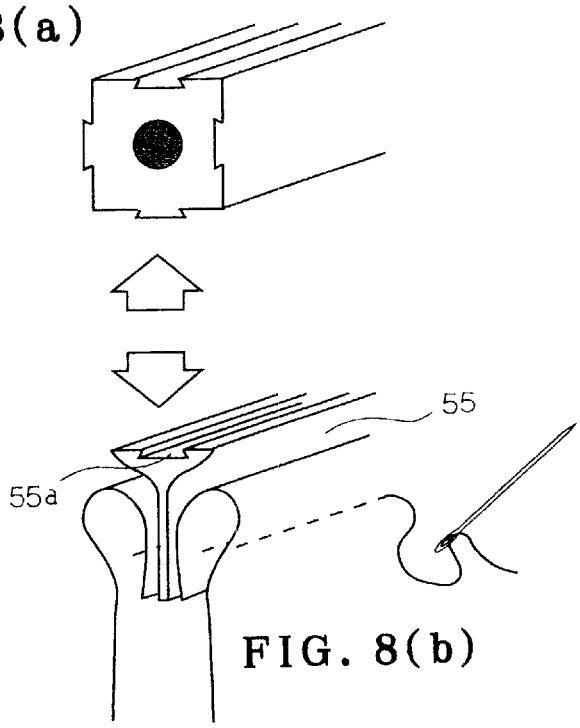
Figure 8D:
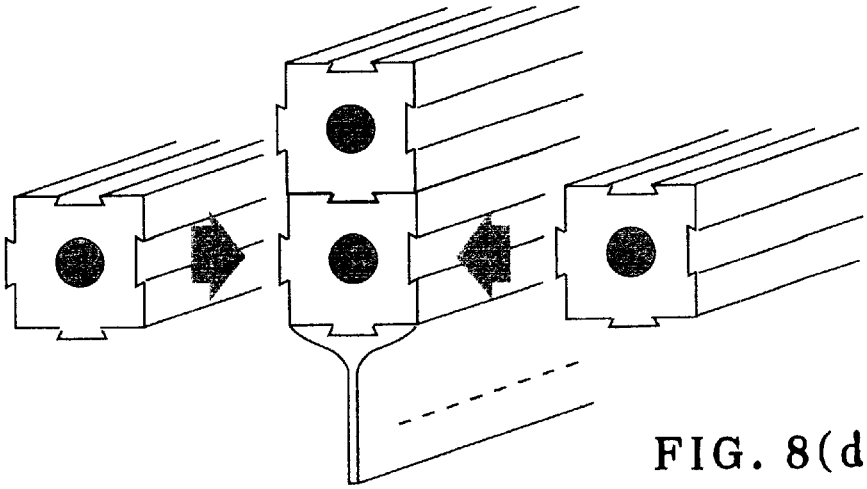
Figure 9A:
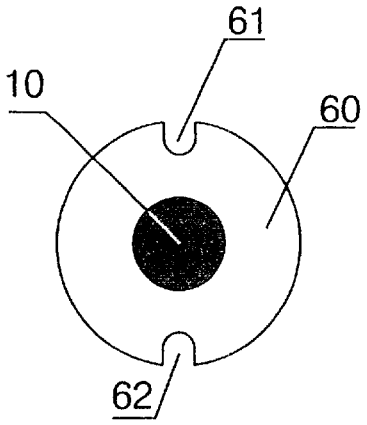
FIGS. 9(*a*)–9(*c*) are diagrams showing another embodiment of the present invention FIGS. 10(*a*)–10(*c*) are diagrams illustrating a connecting terminal.
Figure 9A:
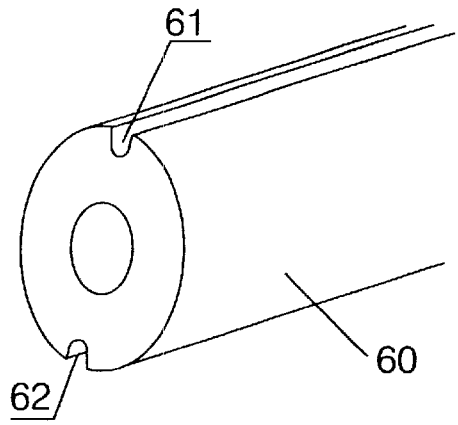
Figure 9A:
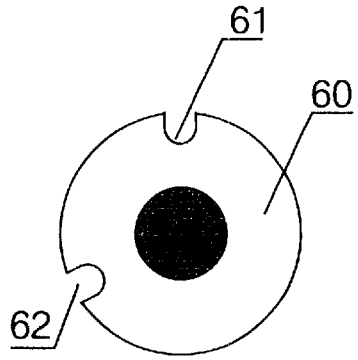
Figure 9B:
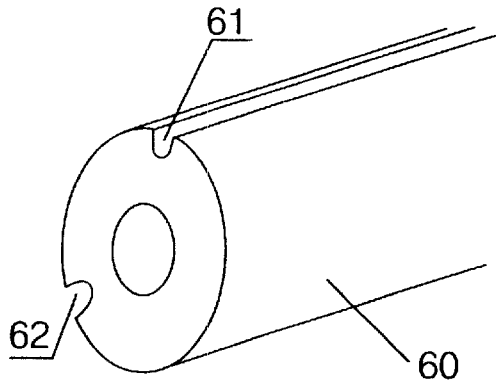
Figure 9C:
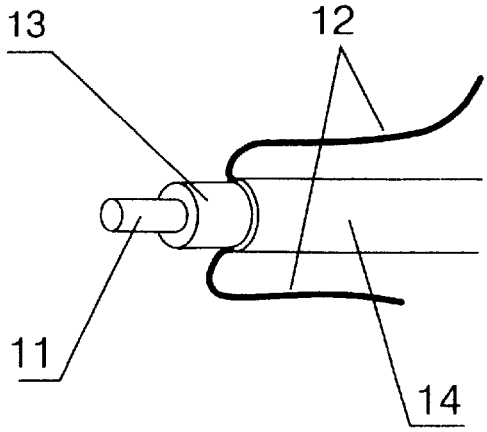

FIG. 5 is a diagram showing another embodiment of the present invention.

In this embodiment, extrusion is carried out by using the same extrusion die as in FIG. 4. During or after the extrusion process, twisting is applied to form a helical serrate pattern 42. This enables the light-diffusion effect to be produced even more remarkably. In this embodiment, the helical serrate pattern 42 serves as a function-assisting portion for assisting the function of the electroluminescence fiber.

Although in FIGS. 4 and 5 the light-diffusion effect is enhanced by an unevenness pattern, it should be noted that a refractive action, a prism effect, a lens effect, etc. may also be imparted to the electroluminescence fiber by properly designing the surface configuration, thereby diversifying the function-assisting portion of the electroluminescence fiber.

Next, examples in which an extrusion die is devised to allow a plurality of linear electroluminescence fibers to be joined together will be described with reference to FIGS. 6 to 8.

FIGS. 6(*a*), (*b*),(*c*-1) and (*c*-2) show an example in which the covering layer has a rectangular sectional configuration, and a pair of mutually opposing surfaces of the covering layer are formed with a guide recess and a projection, respectively. Part (a) of FIG. 6 is a sectional view. Part (b) of FIG. 6 is a diagram illustrating the way in which a plurality of electroluminescence fibers are joined together.

A electroluminescence device 10 is covered with a covering layer 50 by using an extrusion die devised to allow a plurality of electroluminescence fibers to be joined together in parallel, and the covering layer 50 is cured. The extrusion die can form a guide recess and a projection on a pair of mutually opposing surfaces, respectively, of the covering layer 50 having a rectangular sectional configuration. Thus, the extruded covering layer 50 has a guide recess 50*a* and a wedge-shaped projection 50*b* on a pair of mutually opposing surfaces, respectively, of the rectangular covering layer 50, as illustrated in the figure. As shown in part (b) of FIG. 6, a plurality of electroluminescence fibers each formed with the covering layer 50 are juxtaposed horizontally in such a manner that the recess and the projection of each pair of adjacent electroluminescence fibers face each other, and the projection is fitted into the recess to secure the electroluminescence fibers to each other. In this way, a plurality of electroluminescence fibers can be joined together so as to enlarge the width horizontally.

Thus, by forming a guide recess and a projection on the surfaces of the covering layer of each electroluminescence fiber, a plurality of linear electroluminescence fibers, which have heretofore been simply juxtaposed and stuck to each other, can be handled as a group of members. Thus, handling of electroluminescence fibers is facilitated, and the apparent width and amount of light emitted from the electroluminescence fiber assembly can be adjusted easily by a simple operation. Further, the fitting portions are not particularly fixed in the longitudinal direction of the electroluminescence fibers, but each individual electroluminescence fiber can slide independently. Therefore, when a group of electroluminescence fibers are bent for use in a corner, for example, the electroluminescence fibers joined together according to the present invention can be installed flat, as shown in part (c-1) of FIG. 6, without the corner thereof being turned up, whereas a group of electroluminescence fibers simply stuck together in parallel with an adhesive as in the conventional practice are undesirably turned up at the corner thereof as shown in part (c-2) of FIG. 6. In this example, the guide recess 50*a* and the wedge-shaped projection 50*b* serve as function-assisting portions for assisting the function of the electroluminescence fiber.

FIGS. 7(*a*)–7(*d*) show an example in which the covering layer has a trapezoidal sectional configuration, and a guide recess and a projection are formed on a pair of mutually opposing surfaces, respectively, of the covering layer. Part (a) of FIG. 7 is a sectional view, and parts (b), (c) and (d) of FIG. 7 are diagrams illustrating the way in which a plurality of electroluminescence fibers are joined together.

This example differs from the example shown in FIGS. 6 only in that the covering layer 51 covering the electroluminescence device 10 has a trapezoidal sectional configuration. The extrusion die used in this example is designed to be capable of forming a guide recess and a projection on a pair of non-parallel mutually opposing surfaces, respectively, of the covering layer 51 having a trapezoidal sectional configuration. Thus, the extruded covering layer 51 has a guide recess 51*a* and a wedge-shaped projection 51*b* on a pair of non-parallel mutually opposing surfaces, respectively, of the trapezoidal covering layer 51. As shown in part (b) of FIG. 7, a plurality of electroluminescence fibers each formed with the covering layer 51 are juxtaposed horizontally in such a manner that the short and long sides of the trapezoidal sections of each pair of adjacent electroluminescence fibers are in an upside-down relation to each other so that the recess and the projection of each pair of adjacent electroluminescence fibers face each other, and the projection is fitted into the recess to secure the electroluminescence fibers to each other. In this way, a plurality of electroluminescence fibers whose covering layers have a trapezoidal sectional configuration can be joined together horizontally so as to enlarge the width linearly. A plurality of electroluminescence fibers may be joined together as shown in part (c) of FIG. 7. That is, a plurality of electroluminescence fibers are juxtaposed horizontally in such a manner that the short and long sides of the trapezoidal sections of each pair of adjacent electroluminescence fibers face toward the same directions, repectively, so that the recess and the projection of each pair of adjacent electroluminescence fibers face each other, and the projection is fitted into the recess to secure the electroluminescence fibers to each other. Consequently, a plurality of electroluminescence fibers can be joined together so that the cross-section thereof constitutes a part of a polygonal cross-section. Thus, the width can be enlarged. It is also possible to obtain a combined structure having a polygonal sectional configuration, as shown in part (d) of FIG. 7, by joining together electroluminescence fibers annularly. In this example, the guide recess 51*a* and the wedge-shaped projection 51*b* serve as function-assisting portions for assisting the function of the electroluminescence fiber.

FIGS. 8(*a*), (*b*), (*c*) and (*d*) show an example in which the covering layer has a rectangular sectional configuration, and a guide recess or a projection is formed on each surface of the covering layer. Part (a) of FIG. 8 is a sectional view. Part (b) of FIG. 8 is a diagram illustrating the way in which an electroluminescence fiber and a support are joined together. Part (c) of FIG. 8 is a diagram illustrating the way in which another electroluminescence fiber is vertically joined to the electroluminescence fiber shown in part (b) of FIG. 8. Part (d) of FIG. 8 is a diagram illustrating the way in which other electroluminescence fibers are horizontally joined to the electroluminescence fiber joined to the support as shown in part (c) of FIG. 8.

In this example, the covering layer 52 covering the electroluminescence device 10 has a rectangular sectional configuration. The extrusion die used in this example is designed to be capable of forming a guide recess on each of a pair of adjacent surfaces of the rectangular covering layer 52 and a projection on each of another pair of adjacent surfaces of the covering layer 52. The extruded covering layer 52 has a guide recess 52*a* on each of a pair of adjacent surfaces of the rectangular covering layer 52 and a wedge-shaped projection 52*b* on each of another pair of adjacent surfaces of the covering layer 52. Part (b) of FIG. 8 shows a case where a guide recess 55*a* is formed on an electroluminescence fiber support 55 for use in a sewn product, for example, and one wedge-shaped projection of the covering layer is vertically fitted to the guide recess 55*a*. Part (c) of FIG. 8 shows a case where another electroluminescence fiber is positioned so that a projection of the electroluminescence fiber vertically faces one recess of the electroluminescence fiber shown in part (b) of FIG. 8, and the two electroluminescence fibers are joined together. Part (d) of FIG. 8 shows a case where two other electroluminescence fibers are juxtaposed on both sides of the electroluminescence fiber joined to the support 55 as shown in part (c) of FIG. 8 in such a manner that a guide recess and a projection of the two electroluminescence fibers face the other projection and guide recess, respectively, of the electroluminescence fiber joined to the support 55, and the two electroluminescence fibers are joined to the supported electroluminescence fiber. Thus, each surface of the covering layer having a rectangular sectional configuration is formed with a guide recess or a projection, and the electroluminescence fiber support is also formed with a recess for joint, whereby a electroluminescence fiber can be detachably attached to the support, and a plurality of electroluminescence fibers can be combined with each other in various configurations by joining them together vertically and/or horizontally as desired. In this example, when an electroluminescence fiber is at the end of its service life, it can be replaced with a new one easily by a simple operation. In this example, the guide recesses 52*a* and 55*a* and the wedge-shaped projections 52*b* serve as function-assisting portions for assisting the function of the electroluminescence fiber.

FIGS. 9(*a*)–(*c*) are diagrams showing another embodiment of the present invention. Part (a) of FIG. 9 is a sectional view, and part (b) of FIG. 9 is a perspective view. Part (c) of FIG. 9 is a perspective view of an end portion of an electroluminescence fiber, in which illustration of a covering layer is omitted.

In this embodiment, a die used to extrude a resin for covering an electroluminescence device is designed to cut grooves at specified positions on the circumference of an electroluminescence fiber to secure terminal electric wires extending from an end of the electroluminescence device in the grooves. As shown in parts (a) and (b) of FIG. 9, a covering layer 60 extruded to cover an electroluminescence device 10 and cured has grooves 61 and 62 cut at respective positions facing each other at 180 degrees across the center line of the covering layer 60 or at respective positions away from each other at a desired angle other than 180 degrees with respect to the center line of the covering layer 60. As shown in part (c) of FIG. 9, two additional electrodes 12 are embedded in a skin 14 to extend across an electroluminescence layer 13 from a core electrode 11 at the center of the electroluminescence fiber, and led out from an end of the electroluminescence fiber. The two additional electrodes 12 are turned back and accommodated in the grooves 61 and 62, respectively (sec FIG. 9(*b*)). In a case where the grooves 61 and 62 are cut at respective positions facing each other at 180 degrees, the two additional electrodes 12 are led out to the positions facing each other at 180 degrees and accommodated in the grooves 61 and 62. In a case where the grooves 61 and 62 are cut at respective positions facing each other at a predetermined angle other than 180 degrees, the two additional electrodes 12 are led out to the positions corresponding to the angle and accommodated in the grooves 61 and 62. It should be noted that the grooves are cut at positions convenient for the covering layer configuration or the connector configuration Therefore, the positions where the grooves are cut do not always face each other. There are also cases where the number of grooves is three or more. In this embodiment, the grooves for accommodating the electrodes serve as function-assisting portions for assisting the function of the electroluminescence fiber.

Figure 10A:
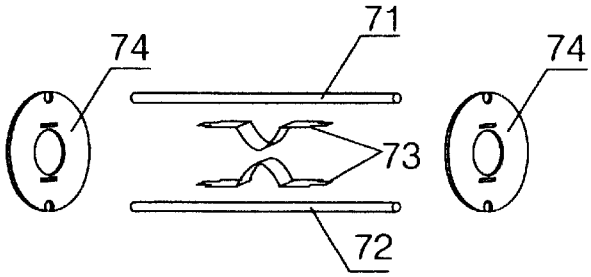
Figure 10B:
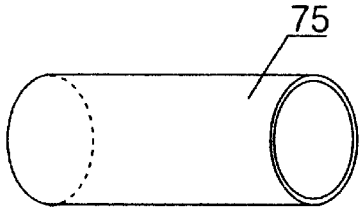
Figure 10C:
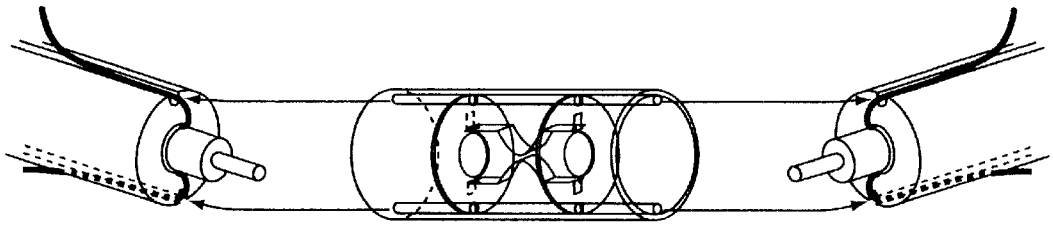

FIGS. 10(*a*)–(*c*) are diagrams illustrating a connecting terminal. Part (a) of FIG. 10 is an exploded view of the terminal. Part (b) of FIG. 10 is a diagram showing a connecting tube. Part (c) of FIG. 10 is a diagram showing the way in which electroluminescence fibers are connected together through the connecting terminal.

As shown in parts (a) and (b) of FIG. 10, the connecting terminal comprises two electrodes 71 and 72 for electrical connection with additional electrodes, contacts 73 for contact with core electrodes, fastening members 74 for securing the contacts 73 and for fitting with the central portions of electroluminescence fibers, and a tube 75 for accommodating the electrodes 71 and 72, the contacts 73 and the fastening members 74. As shown in part (c) of FIG. 10, the electrodes 71 and 72, the contacts 73 and the fastening members 74 are accommodated in the tube 75, and the end portions of electroluminescence fibers having conductors secured in the grooves 61 and 62 (see FIG. 9(*b*)) are inserted into the tube 75 in such a manner that the additional electrodes and the electrodes 71 and 72 are aligned with each other. Thus, connection is completed. The conventional joint needs to prepare circumferentially extending electrodes for the connecting terminal because the positions of the additional electrodes on each electroluminescence fiber are not determined. According to this embodiment, even if the number of additional electrodes increases to three or four, the electrode positions are determined by cutting grooves in accordance with the number of additional electrodes. Therefore, electrodes of the connecting terminal need to be disposed only at specified positions, and connection can be effected easily. In this embodiment also, the grooves for accommodating the electrodes serve as function-assisting portions for assisting the function of the electroluminescence fiber.

FIGS. 11(*a*), (*b*), (*c*-1) and (*c*-2) are diagrams illustrating another example of the connecting terminal. Part (a) of FIG. 11 is an exploded view of the terminal. Part (b) of FIG. 11 is a diagram showing a connecting tube. Parts (c-1) and (c-2) of FIG. 11 show the way in which electroluminescence fibers are connected through the connecting terminal. In this example, each electroluminescence fiber has two core electrodes and two electroluminescence layers to enhance the luminance.

As shown in parts (a) and (b) of FIG. 11, the connecting terminal comprises electrodes 76 and 77 for electrical connection with core electrodes or additional electrodes, a fastening member 78 for securing the electrodes 76 and 77, and a tube 75 for accommodating the electrodes 76 and 77 and the fastening member 78. As shown in parts (c-1) and (c-2) of FIG. 11, the electrodes 76 and 77 and the fastening member 78 are accommodated in the tube 75, and the end portions of electroluminescence fibers having conductors secured in the grooves 61 and 62 (see FIG. 9) are inserted into the tube 75 in such a manner that the grooves 61 and 62 and the electrodes 76 and 77 are aligned with each other. In an example shown in part (c-1) of FIG. 11, the core electrodes in the electroluminescence layers of each electroluminescence fiber are accommodated in the upper and lower grooves, respectively, by way of example, and the core electrodes of the two electroluminescence fibers are connected to each other through the electrodes 76 and 77. Part (c-2) of FIG. 11 shows an example in which the core electrodes are accommodated in the upper groove of each electroluminescence fiber, and the additional electrodes are accommodated in the lower groove, by way of example, and in this state, the two electroluminescence fibers are connected together. In this example also, the grooves for accommodating the electrodes serve at function-assisting portions for assisting the function of the electroluminescence fiber.

Figure 12:
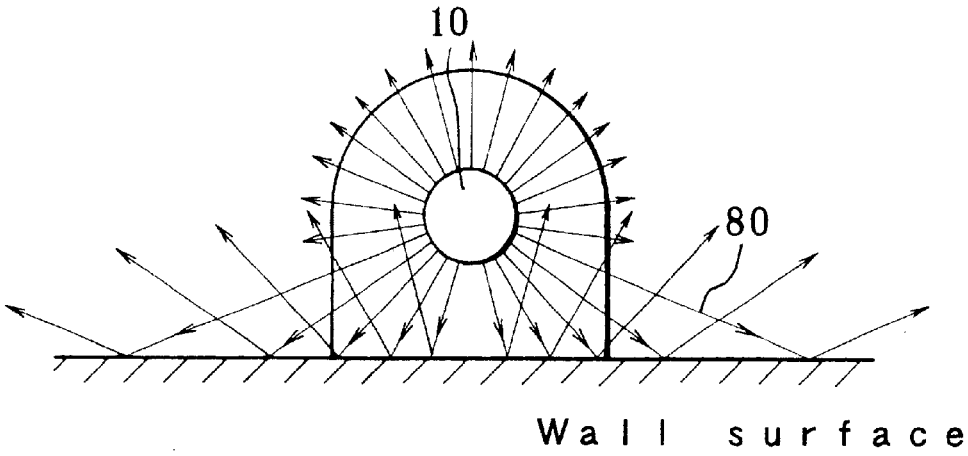
FIG. 12 is a diagram illustrating divergence of light at a flat surface.

In each of the foregoing embodiments, when the electroluminescence fiber is additionally provided with a flat surface portion or a mounting portion, in particular, to use it in such a way that the electroluminescence fiber is fitted to a wall surface or the like and seen from the front thereof as in the case of a signboard, as shown in FIG. 12, light 80 at the rear of the electroluminescence fiber is reflected to diverge at the wall surface. Thus, the light 80 is wasted without being utilized effectively. To solve this problem, a reflector should preferably be formed within a resin when it is extruded to cover the surface of the electroluminescence device, as will be stated below with regard to application examples shown in FIGS. 13 to 16.

Figures 13A, 13B:
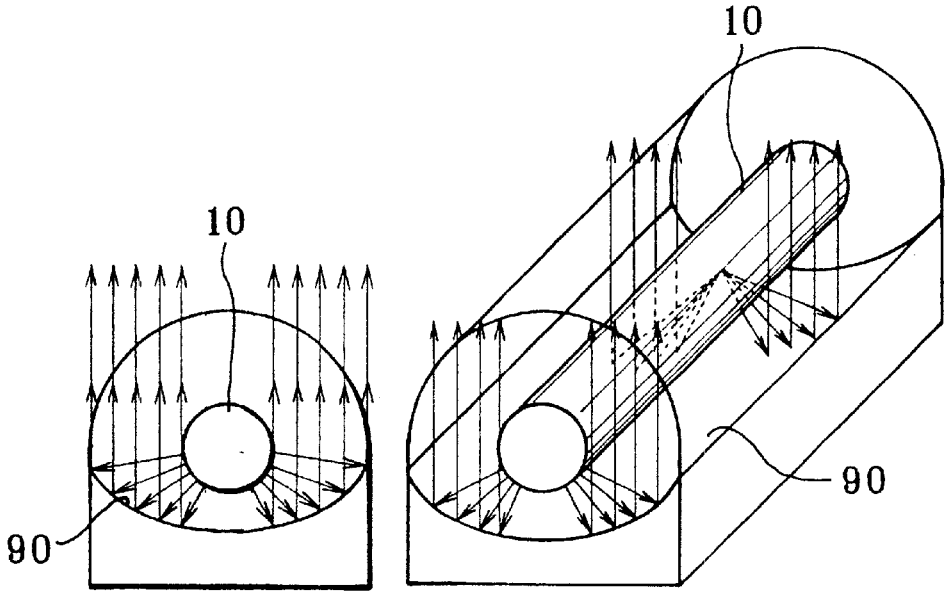
FIGS. 13(*a*) and 13(*b*) are diagrams showing an application example of preventing divergence of light.

FIGS. 13(*a*) and (*b*) are diagrams showing an example in which the present invention is applied to a semicylindrical electroluminescence fiber having one flat surface. Part (a) of FIG. 13 is a sectional view, and part (b) of FIG. 13 is a perspective view. In this example, a reflector 90 is formed inside the semicylindrical electroluminescence fiber at a side of the electroluminescence device closer to the flat surface of the electroluminescence fiber to reflect light toward the front. Accordingly, when the electroluminescence fiber is used in such a way that it is seen from the front with the flat surface thereof secured to a wall surface or the like, light emitted toward the rear of the electroluminescence fibers reflected by the reflector (concave reflector in this example) 90 toward the front. Thus, the light can be utilized effectively. In this example, the reflector 90 serves as a function-assisting portion for assisting the function of the electroluminescence fiber.

Figure 14A:
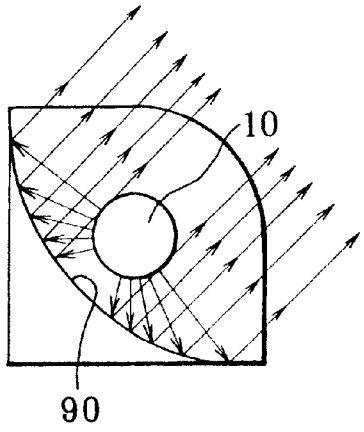
FIGS. 14(*a*) and 14(*b*) are diagrams showing another application example of preventing divergence of light.
Figure 14B:
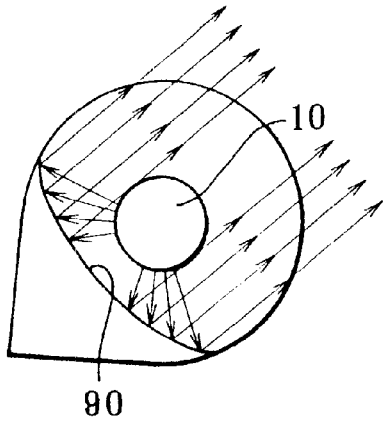

FIGS. 14(*a*) and (*b*) are diagrams showing an example in which the present invention is applied to an electroluminescence fiber having two flat surface portions. Part (a) of FIG. 14 shows an electroluminescence fiber in which an exit surface from which light emerges consists of planar portions and a curved portion Part (b) of FIG. 14 shows an electroluminescence fiber having an exit surface with a spherical configuration.

In this example, a reflector 90 is formed inside the electroluminescence fiber to extend over two flat surfaces, whereby light emitted from an electroluminescence device 10 toward the two flat surfaces is directed toward the front. This arrangement can be effectively utilized when the electroluminescence fiber is fitted to a corner between a wall surface and a floor, for example. In this example also, the reflector 90 serves as a function-assisting portion for assisting the function of the electroluminescence fiber.

Figure 15:
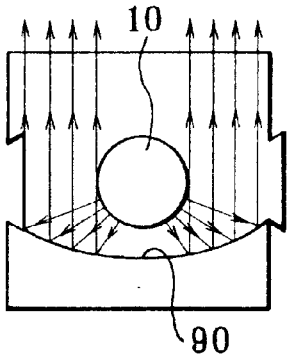
FIG. 15 is a diagram showing another application example of preventing divergence of light.

FIG. 15 is a diagram showing an example in which the present invention is applied to an electroluminescence fiber having a guide recess and a projection formed on a pair of mutually opposing surfaces.

In this example, surfaces contiguous to the mutually opposing surfaces formed with the guide recess and the projection are flat surfaces. A reflector 90 is formed to reflect light traveling toward the rear flat surface back to the front in the same way as in the case of FIG. 13, thereby effectively utilizing light. In this example, the guide recess and the projection as well as the reflector 90 serve as function-assisting portions for assisting the function of the electroluminescence fiber.

Figure 16A:
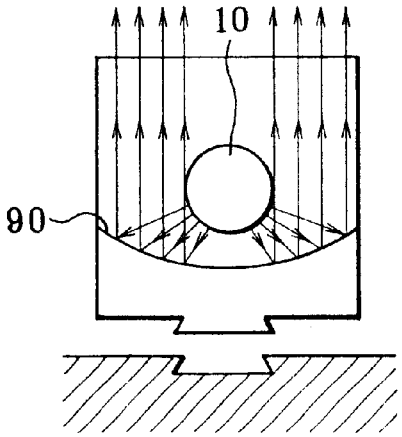
FIGS. 16(*a*) and 16(*b*) are diagrams showing another application example of preventing divergence of light FIGS. 17(*a*) and 17(*b*) are diagrams showing an application example of preventing divergence of light in a two-core electroluminescence fiber.
Figure 16B:
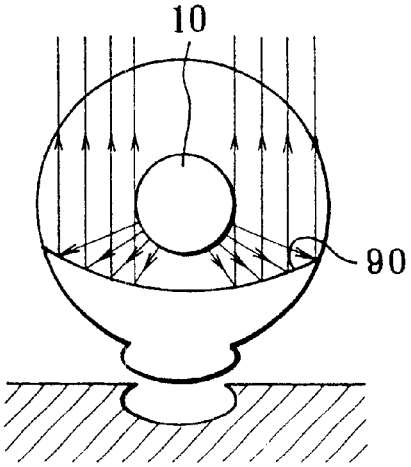

FIGS. 16(*a*) and (*b*) are diagrams showing an example in which the present invention is applied to an electroluminescence fiber having a guide projection adapted to be fitted into a recess of a support Part (a) of FIG. 16 shows an example in which a guide projection is formed on an electroluminescence fiber having a rectangular sectional configuration. Part (b) of FIG. 16 shows an example in which a guide projection is formed on an electroluminescence fiber having a circular sectional configuration.

In this application example, a reflector 90 is formed to reflect light traveling toward a surface formed with a guide projection adapted to be fitted into a recess of a support such that the reflected light is directed toward the front of the electroluminescence fiber, thereby making effective use of light. In this example, the reflector 90 and the projection for mounting serve as function-assisting portions for assisting the function of the electroluminescence fiber.

Figure 1A:
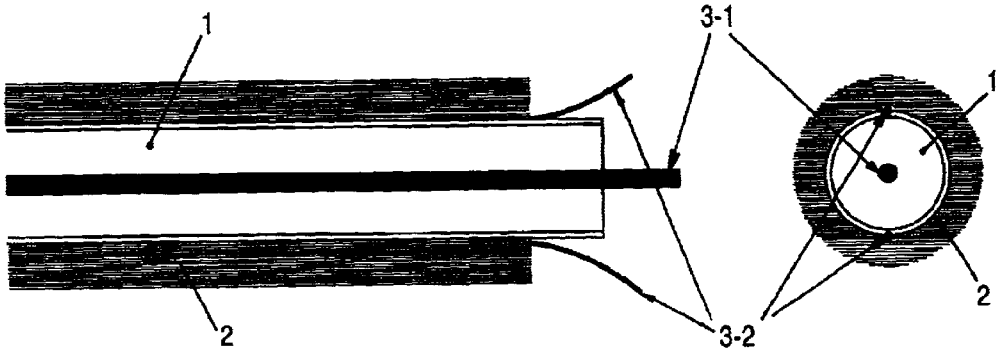
FIG.1(a) PRIOR ART
FIGS. 1(*a*) and 1(*b*) are diagrams illustrating the general arrangement of electroluminescence fibers.
Figure 1B:
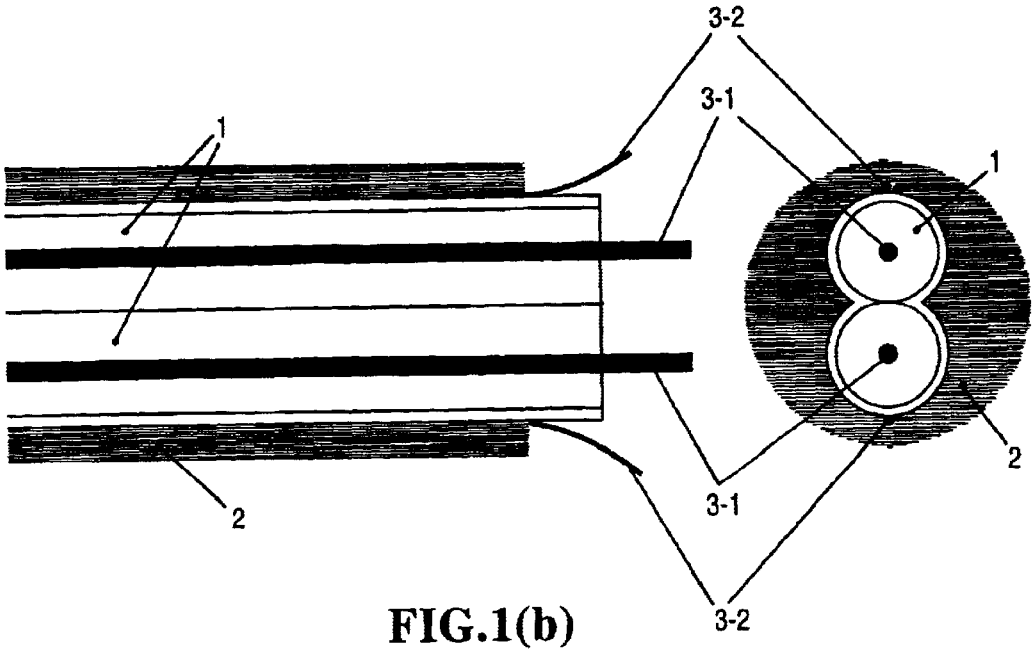
FIG.1(b) PRIOR ART

In the application examples shown in FIGS. 13 to 16, the present invention has been described with regard to the single-core type electroluminescence fibers. It should be noted, however, that the present invention is also applicable to a two-core type electroluminescence fiber as shown in part (b) of FIG. 1. Examples in which the present invention is applied to two-core electroluminescence fibers will be described below with reference to FIGS. 17 to 20.

Figure 17A:
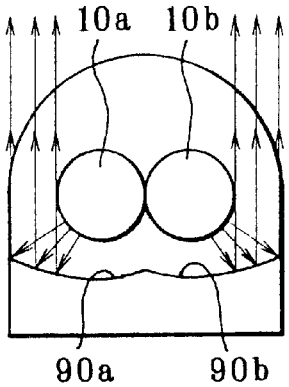
Figure 17B:
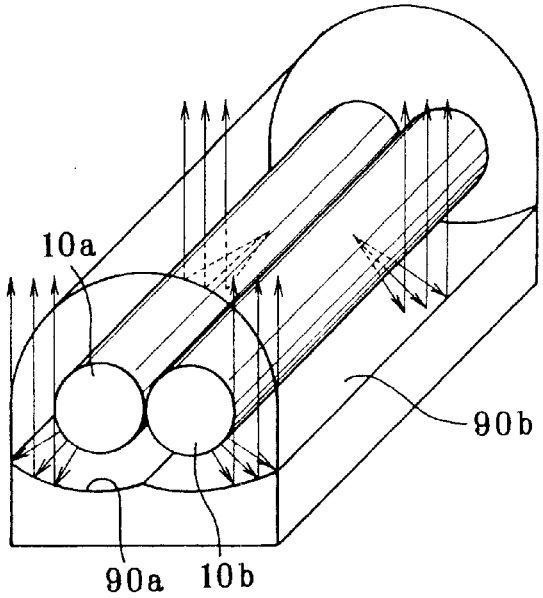

FIGS. 17(*a*) and (*b*) are diagrams showing an example in which the present invention is applied to a semicylindrical electroluminescence fiber having one flat surface. Part (a) of FIG. 17 is a sectional view, and part (b) of FIG. 17 is a perspective view. In this example, reflectors 90*a* and 90*b* are formed inside the semicylindrical electroluminescence fiber at respective sides of two electroluminescence devices 10*a* and 10*b* closer to the flat surface of the electroluminescence fiber to reflect light from each electroluminescence device toward the front. Accordingly, light emitted toward the rear of the electroluminescence fiber is reflected by the reflectors (concave reflectors in this example) 90*a* and 90*b*, toward the front. Thus, the light can be utilized effectively. The reflectors 90*a* and 90*b* serve as function-assisting portions for assisting the function of the electroluminescence fiber.

Figure 18:
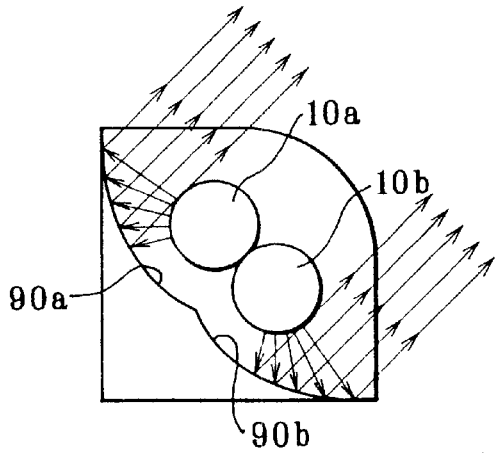
FIG. 18 is a diagram showing another application example of preventing divergence of light in a two-core electroluminescence fiber.

FIG. 18 is a diagram showing an example in which the present invention is applied to an electroluminescence fiber having two flat surface portions, in which an exit surface from which light emerges consists of planar portions and a curved portion.

In this example, reflectors 90*a* and 90*b* are formed inside the electroluminescence fiber to extend over two flat surfaces, whereby light emitted from two electroluminescence devices 10*a* and 10*b* toward the two flat surfaces is directed toward the front. This arrangement can be effectively utilized when the electroluminescence fiber is fitted to a corner between a wall surface and a floor, for example. The reflectors 90*a* and 90*b* serve as function-assisting portions for assisting the function of the electroluminescence fiber.

Figure 19:
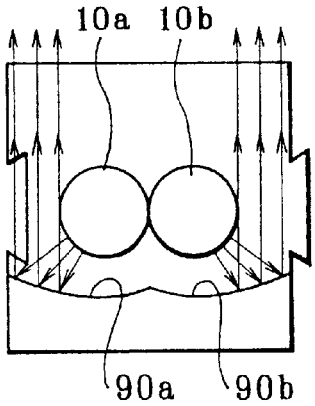
FIG. 19 is a diagram showing another application example of preventing divergence of light in a two-core electroluminescence fiber.

FIG. 19 is a diagram showing an example in which the present invention is applied to an electroluminescence fiber having a guide recess and a projection formed on a pair of mutually opposing surfaces.

In this example, surfaces contiguous to the mutually opposing surfaces formed with the guide recess and the projection are flat surfaces. Reflectors 90*a* and 90*b* are formed to reflect light emitted from two electroluminescence devices 10*a* and 10*b* toward the rear flat surface such that the reflected light is directed toward the front, thereby effectively utilizing light. The guide recess and the projection as well as the reflectors 90*a* and 90*b* serve as function-assisting portions for assisting the function of the electroluminescence fiber.

Figure 20:
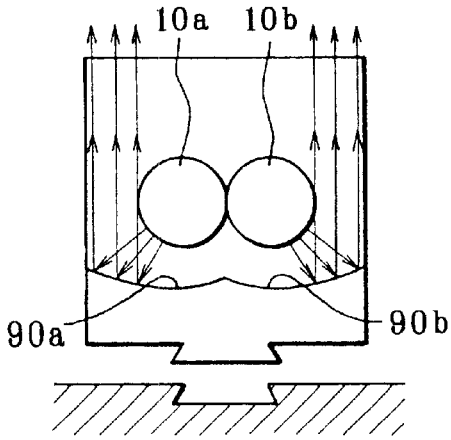
FIG. 20 is a diagram showing another application example of preventing divergence of light in a two-core eletroluminescence fiber.

FIG. 20 is a diagram showing an example in which the present invention is applied to an electroluminescence fiber having a guide projection adapted to be fitted into a recess of a support.

In this example, reflectors 90*a* and 90*b* are formed to reflect light emitted from two electroluminescence devices 10*a* and 10*b* toward a surface formed with a guide projection adapted to be fitted into a recess of a support such that the reflected light is directed toward the front of the electroluminescence fiber, thereby making effective use of light. The reflectors 90*a* and 90*b* and the projection for mounting serve as function-assisting portions for assisting the function of the electroluminescence fiber.

Although the reflectors 90, 90*a* and 90*b* in the foregoing examples each have a reflecting surface formed inside the resin, a reflecting surface of each reflector can be formed by using other appropriate methods. For example, the outer surface of the resin may be coated with a reflecting member to form a reflecting surface.

Although in the foregoing embodiments a thermoplastic resin is used to form the covering layer, it should be noted that a thermosetting resin or an ultraviolet-curing resin is also usable in place of the thermoplastic resin. An optimum resin material should be used according to service environmental conditions.

As has been stated above, the present invention provides the following advantages. When the peripheral surface of an electroluminescence device is covered with a thermoplastic resin, a thermosetting resin or an ultraviolet-curing resin to produce an electroluminescence fiber and to retain the shape thereof, the resin surface is integrally formed with a function-assisting portion for assisting the function of the electroluminescence fiber by extrusion process using an extrusion die with various schemes devised for the surface configuration of the electroluminescence fiber as cut crosswise. Accordingly, it becomes possible to attain ease of attaching the electroluminescence fiber to a wall surface, a sewn part, etc., ease of electrical connection, and ease of increasing the amount and apparent width of light emitted from the electroluminescence fiber. In addition, it is possible to utilize light effectively by forming a reflector inside the resin or on the outer surface of the resin so that light is not wasted by diverging at an installation surface or the like.

I claim:

1. A flexible electroluminescence fiber comprising:

an electroluminescence filament comprising electrodes disposed inside and outside an electroluminescence material;

a resin material covering a surface of said electroluminescence filament, said resin material being cured and one selected from the group consisting of a thermoplastic resin, a thermosetting resin, and an ultraviolet-curing resin; and a function-assisting portion for assisting a function of said electroluminescence fiber, said function-assisting portion being integrally formed with said resin material;

wherein said function-assisting portion is at least one flat surface portion formed on a surface of said resin material.

2. A flexible electroluminescence fiber comprising:

an electroluminescence filament comprising electrodes disposed inside and outside an electroluminescence material;

a resin material covering a surface of said electroluminescence filament, said resin material being cured and one selected from the group consisting of a thermoplastic resin, a thermosetting resin, and an ultraviolet-curing resin; and a function-assisting portion for assisting a function of said electroluminescence fiber, said function-assisting portion being integrally formed with said resin material;

wherein said function-assisting portion is at least one of an unevenness pattern for diffusion or reflection of light and a prism- or lens-shaped portion formed on a surface of said resin material.

3. A flexible electroluminescence fiber comprising:

an electroluminescence filament comprising electrodes disposed inside and outside an electroluminescence material;

a resin material covering a surface of said electroluminescence filament, said resin material being cured and one selected from the group consisting of a thermoplastic resin, a thermosetting resin, and an violet-curing resin; and a function-assisting portion for assisting a function of said electroluminescence fiber, said function-assisting portion being integrally formed with said resin material;

wherein said function-assisting portion is a fitting groove portion or a projection formed on a surface of said resin material to join with at least one of an adjacent electroluminescence fiber and a fixer for electroluminescence fiber.

4. A flexible electroluminescence fiber comprising:

an electroluminescence filament comprising electrodes disposed inside and outside an electroluminescence material;

a resin material covering a surface of said electroluminescence filament, said resin material being cured and one selected from the group consisting of a thermoplastic resin, a thermosetting resin, and an ultraviolet-curing resin; and a function-assisting portion for assisting a function of said electroluminescence fiber, said function-assisting portion being integrally formed with said resin material;

wherein said function-assisting portion is a groove formed on a surface of said resin material to secure a wiring end portion of each of said electrodes.

5. A flexible electroluminescence fiber comprising:

an electroluminescence filament comprising electrodes disposed inside and outside an electroluminescence material;

a resin material covering a surface of said electroluminescence filament, said resin material being cured and one selected from the group consisting of a thermoplastic resin, a thermosetting resin, and an ultraviolet-curing resin; and a function-assisting portion for assisting a function of said electroluminescence fiber, said function-assisting portion being integrally formed with said resin material;

wherein said function-assisting portion is a reflector for directing light emitted from said electroluminescence filament.

* * * * *